United States Patent [19]

Cooper

[11] Patent Number: 4,864,279

[45] Date of Patent: Sep. 5, 1989

[54] WARNING DEVICE ACTIVATED BY A KEY LEFT IN A LOCK

[76] Inventor: Emanuel Cooper, 66 W. 94th St., New York, N.Y. 10025

[21] Appl. No.: 227,281

[22] Filed: Aug. 2, 1988

[51] Int. Cl.[4] ..... G08B 13/14; H01H 27/06

[52] U.S. Cl. ..... 340/568; 200/43.05; 200/61.62; 200/61.66; 340/686

[58] Field of Search .... 200/43.01, 43.02, 43.16–43.21, 200/61.62–61.68, 52 R; 70/DIG. 049, 432, 434; 340/540, 542, 545, 548, 549, 568, 686, 687

[56] References Cited

U.S. PATENT DOCUMENTS 901,983 10/1908 Metzger ..... 200/61.66

1,562,039 11/1925 Nowakowski ..... 200/61.66

4,658,106 4/1987 Makoe ..... 200/61.68 X

*Primary Examiner*—J. R. Scott

*Attorney, Agent, or Firm*—Cohen, Pontani & Lieberman

[57] ABSTRACT

A warning device is operable to indicate that a key has been inadvertently or otherwise unknowingly left in a lock. A movable member normally prevents insertion of a key into the lock keyhole and is manually movable to a temporary remote position permitting insertion and use of the key. Subsequent release of the movable member causes it to return to its initial position and, if the key remains in the lock, into contact with the key thereby completing an electrical circuit connection between the movable member and a signalling device which is accordingly operated to warn the user that the key has been left in the lock.

6 Claims, 3 Drawing Sheets

FIG. 5
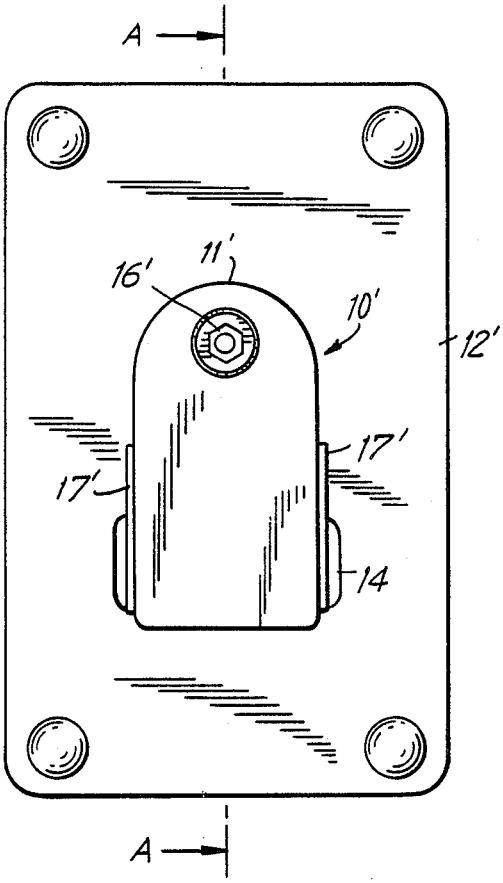
FIG. 6
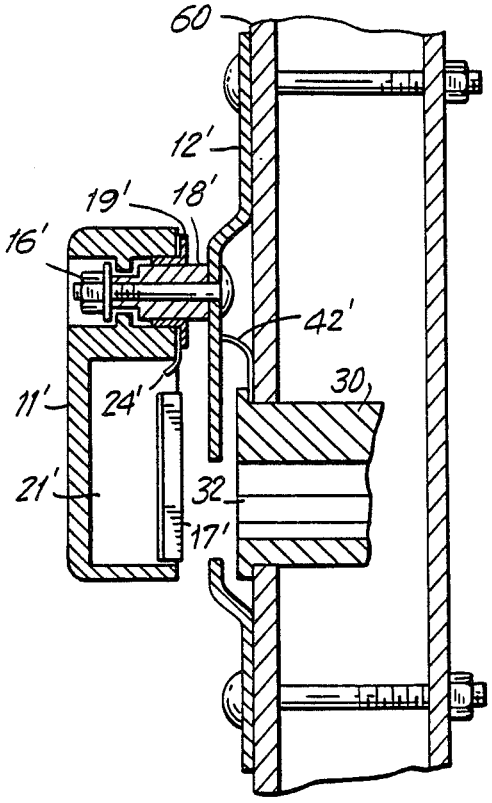
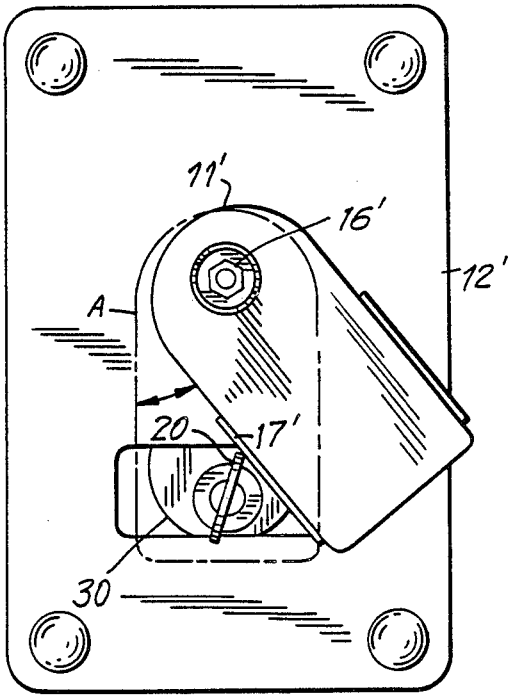
FIG. 7
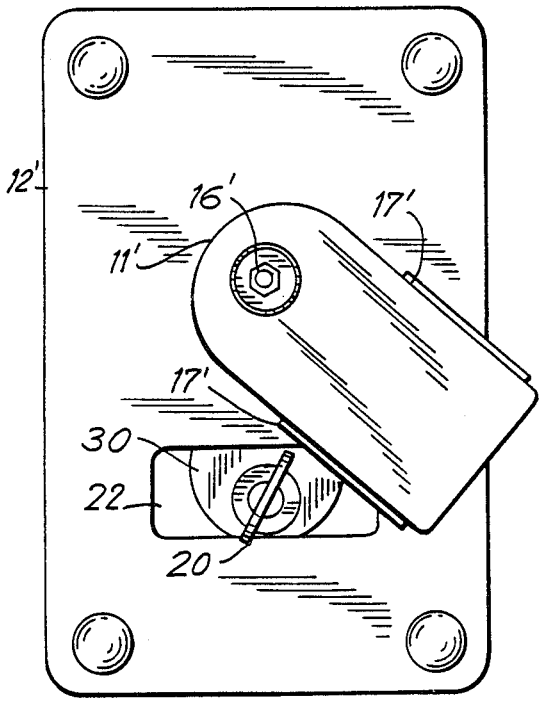
FIG. 8

WARNING DEVICE ACTIVATED BY A KEY LEFT IN A LOCK

FIELD OF THE INVENTION The present invention relates to warning devices for indicating that a key has been inadvertently left inserted in a lock.

BACKGROUND OF THE INVENTION

It is not uncommon for a user seeking entry to a locked room or dwelling, mind preoccupied with various matters and/or hands holding or maneuvering a multiplicity of bags or packages and the like, to unlock the passage door with the appropriate key and then, in gaining entry to the formerly restricted area, to leave the key in the lock keyhole. Sometimes the user knowingly leaves the key in the lock with the intention of returning to the door to recover the key after ridding himself of packages, bags and outer clothing or the like. In other instances the user may simply forget or not realize his failure to remove the key from the lock before the door is manually closed or is automatically caused to shut by a commonly spring-loaded design. In numerous such instances, the key remains in the door lock for an extended period of time, and is often not missed or recovered until the next time that the user seeks to leave the locked area. All too often, by that time the key has been removed by unknown persons who may intend to use the key for unconsented to, unrestricted and possibly unlawful access into the locked space.

Prior art devices have recognized this problem and have accordingly sought to alert the user to his omission with an alarm. These prior art arrangements, however, have not been entirely satisfactory.

U.S. Pat. No. 901,983 provides an example of an alarm device which is activated by insertion of a key or tool into a keyhole of a lock. In this alarm device a displaceable pin is inserted into the keyhold from one side of the lock. When a key or other object is inserted into the keyhole it pushes the pin out of the keyhole and into abutment with an electrical contact to close an alarm circuit and sound a warning alarm. The alarm sounds as long as the key remains in the lock or tampering with the lock continues.

Alarm devices of this type suffer the annoying disadvantage that the alarm continuously sounds for the entire period that a key is inserted in the lock. In addition, the alarm device disclosed in U.S. Pat. No. 901,983 works only in those locks having two keyholes, respectively accessible from both sides of the door in which the lock is installed.

A need therefore exists for a warning device which will sense the presence of a key in a lock but which will not produce warning alarm unless the key is inadvertently left in the lock. Additionally, there exists a further need for a warning device which can be used in association with virtually any type of commercially available lock so long as the lock is operated by a key.

SUMMARY OF THE INVENTION

The present invention provides a warning device for alerting a user that a key has been inadvertently or otherwise left in a lock keyhole. The alarm device according to the invention includes a movable contact means which is displaceable from a first position wherein it overlies the keyhole to a second position wherein the contact means is disposed remote from and therefore does not interfere with insertion of the key into the keyhole for operating the lock.

The warning device further includes an indicator circuit which is closed to activate an audible alarm, for example, when the contact means is carried into abutment with a metal key left in the lock, and which circuit is open at all other times.

The warning device may further include a battery for powering the indicator circuit.

BRIEF DESCRIPTION OF THE DRAWING In the drawing, wherein similar reference numerals denote similar elements throughout the several views:

FIG. 3 is a front view of the warning device shown in

FIG. 5 is a front view of another embodiment of the warning device according to the invention;

FIG. 6 is a side cross-sectional view taken along line 6—6 of the warning device shown in FIG. 5;

FIGS. 7 and 8 are front views of the warning device shown in FIG. 5;

DESCRIPTION OF THE PREFERRED EMBODIMENTS

A first and currently most preferred embodiment of a warning device constructed in accordance with the present invention is illustrated in FIGS. 1 to 4.

Figure 1:
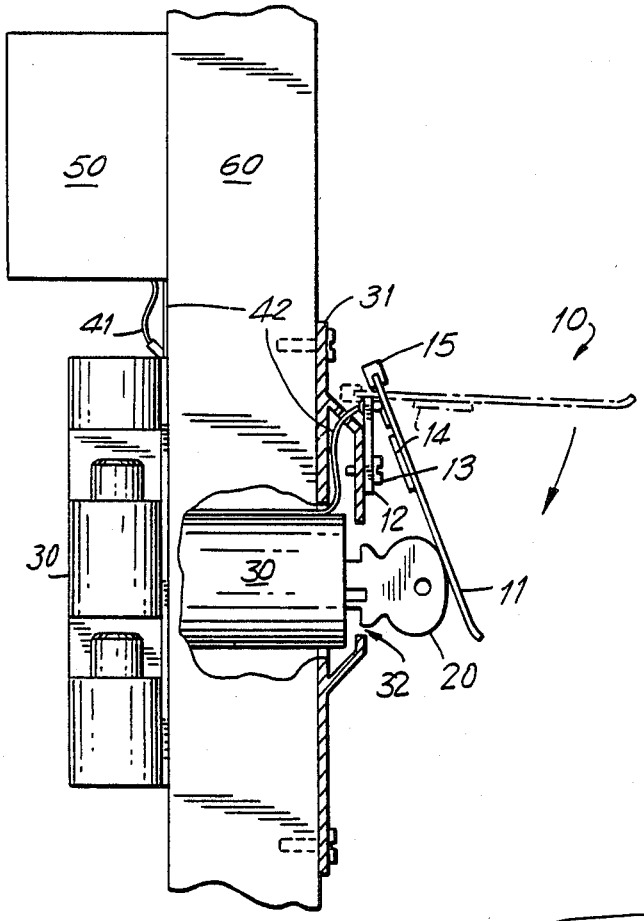
FIG. 1 is side view, partly in cross-section, of a warning device according to the invention.
Figure 3:
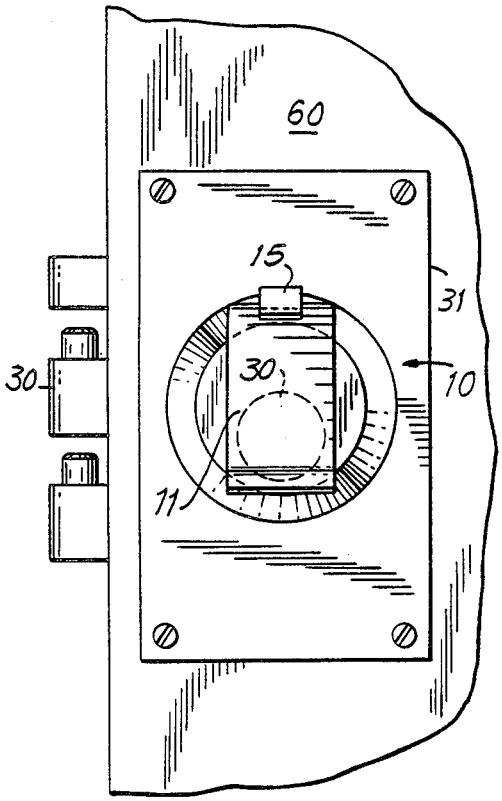

FIG. 1 shows a typical passage or cylinder lock 30 installed in an entry door 60. The conventional lock 30 is formed in its entirety of an electrically conductive metallic material such, for example, as hardened steel. A housing 50 for an alarm is attached to the inside of the door 60. The lock 30 includes a faceplate 31 and a keyhole 32 accessible from the outside of the door. A key 20 for operating the lock 30 is shown inserted into the keyhole 32.

As seen in FIG. 1, the warning or alarm device according to the invention includes a selectively movable contact means 10 including a flap 11 which is manually displaceable between a first position (not illustrated in FIG. 1) wherein at least a portion of the flap 11 is disposed substantially adjacent or proximate the keyhole 32 and a second position (depicted by dotted lines) remote from the keyhole. In the first position the proximity of flap 11 to keyhole 32 is such that a user is unable to insert a key 20 into the keyhole for operating the lock 30. With the flap 11 displaced, on the other hand, to its second position the flap is disposed sufficiently remote or spaced from the keyhole 32 so as to not interfere with insertion of the key into the keyhole.

In the embodiment of the invention illustrated in FIGS. 1 to 4, the flap 11 is pivotally attached to a preferably electrically nonconductive mounting plate 12 which is itself secured to the faceplate 31 by a mounting screw or screws 13. The pivotal mounting of flap 11 is arranged so that the flap is normally biased, preferably at least in part under the force of gravity, to its first position in which the flap is disposed in substantially vertical orientation. Optionally, such biasing of flap 11 to its first position may be implemented or enhanced with a suitable spring arrangement (not shown). The flap 11 carries a pad 14 on its rear face adjacent mounting screw(s) 13 and a bumper 15 proximate an end of the flap remote from that normally located substantially adjacent keynote 32.

Figure 2:
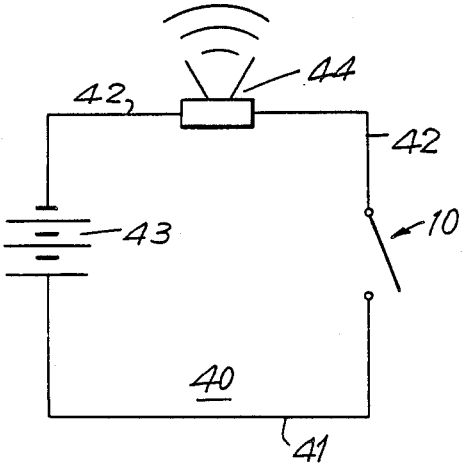
FIG. 2 is a schematic circuit diagram of the warning device of the invention as shown in FIG. 1.

A schematic circuit diagram for the warning device of the invention is illustrated, by way of example, in FIG. 2. The indicator circuit 40 includes a first lead wire 41 which is connected at on end to the lock 30 and at the other to one of the poles of a battery 43. A second lead wire 42 connects the opposite pole of battery 43, through an alarm or indicator device 44 such as an audible bell or buzzer 44 and/or a light (not shown), to the displaceable contact means 10. The flap 11 accordingly functions in the manner of the commutator of a switch for alternately opening and closing o completing the series electrical circuit shown in FIG. 2 to operate the alarm 44.

Figure 4:
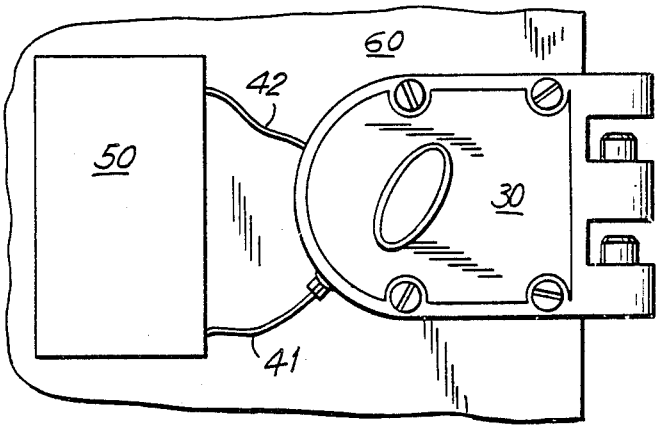
FIG. 4 is a of the warning device shown in FIG. 1.
Figure 9:
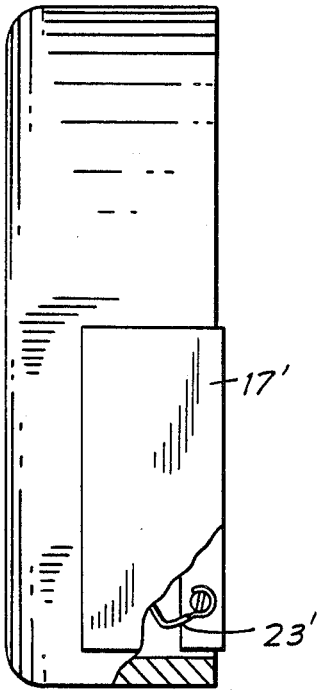
FIG. 9 is a side view, partly in cross-section, of a pendulum employed in the alarm device shown in FIG. 5.

Preferably, the battery 43 and the alarm device 44 are contained within the housing 50 which may be conveniently mounted or secured to the inside of entry door 60, as shown in FIGS. 1 and 4. Of course, many alternate arrangements and locations of the indicator device or alarm 44, and of the battery 43 or other power source, can be employed in accordance with the invention.

Those skilled in the art will recognize and appreciate that, in the embodiment of the invention disclosed in FIGS. 1 to 4, the flap 11 must normally be maintained in electrically isolated relation to the lock 30 except, of course, when the warning device is activated to set off an alarm. The specific manner in which such isolation is implemented or accomplished is not critical to the invention.

Thus, in the particular form of the invention illustrated in FIG. 1, the metallic faceplate 31 mounted on door 60 and peripherally surrounding the keyhole-bearing face of the lock is electrically isolated from flap 11 by the nonconductive mounting plate 12 disposed therebetween. Many other arrangements, far too numerous to describe, for maintaining an electrical isolation between the flap 11 and lock 30 are alternately available. For example, electrical isolation—as by mechanical separation or spacing—of faceplate 31 from lock 30 may be employed in lieu of constructing mounting plate 12 of a nonconductive material. This and other alternative arrangements are within the scope and contemplation of the invention and may be readily implemented by those of ordinary skill in the art.

In use, the normal or first position of flap 11 sufficiently and proximately overlies the lock keyhole 32 so as to interfere with and prevent insertion of a key 20 into the keyhole. To insert the key, the flap 11 must first be manually moved to o toward its second position by pivoting the flap upwardly about its attachment to mounting plate 12 whereby that portion of the flap normally disposed in proximately overlying relation to the keyhole 32 is displaced into spaced apart relation to the keyhole. Because of the bias of flap 11 which, either under the natural force of gravity and/or by a spring or other instrumentality-induced urgency causes it to constantly seek to return to its first position, it is necessary that the user hold the flap out of its first position while the key 20 is inserted into the keyhole 32 and, generally, as the key is rotated to unlock or otherwise operate the lock 30. With the door unlocked and/or opened to enable entry to the controlled access area, the key 20 may then be removed from the lock keyhole in the usual manner and the flap 11 released by the user to permit the return of the flap to its substantially vertical first position. In this scenario, no warning or alarm is necessary and, therefore, none is sounded or otherwise actuated.

Where, on the other hand, the flap 11 is released from its second position while a key 20 remains in the keyhole 32, that portion of the flap which is disposed proximate the keyhole in the first position of the flap is carried into abutment or contact with the projecting bow of the key a the flap returns from its second to its first position. Of course, the flap may alternatively contact, as it returns from its second toward its first position, a key ring or key holder or like conductive member attached to the key for activating the warning device of the invention. In any event, a series electrical circuit is thereby completed through battery 43, wire 42, indicating or signaling device 44, flap 11, key 20, the body of lock 30, and wire 41 (which provides a return path to battery 43), respectively, causing operation of the signaling device 44 and alerting the use that the key 20 has been left in the door lock. The signaling device 44 preferably continues to emit an alarm until the user has removed the key from the lock, although alternate forms of the invention wherein the alarm automatically terminates after a predetermined or presettable time period are also contemplated. The alarm so generated may also be continuous, or pulsed, or periodic, or of otherwise varying intensity and/or frequency or the like as a matter of design choice; similarly, the alarm may offer an automatic or optional and, if desired, selectively presettable time-delay prior to initiating an indication to the user that the key has been left in the lock.

An alternative embodiment of the warning device of the invention is illustrated in FIGS. 5 through 11. As there shown, a displaceable contact means 10' includes a pendulum 11' which is pivotally secured to mounting plate 12' by at least a mounting bolt 16'. The pendulum 11' includes contact faces or surfaces 17'.

Figure 10:
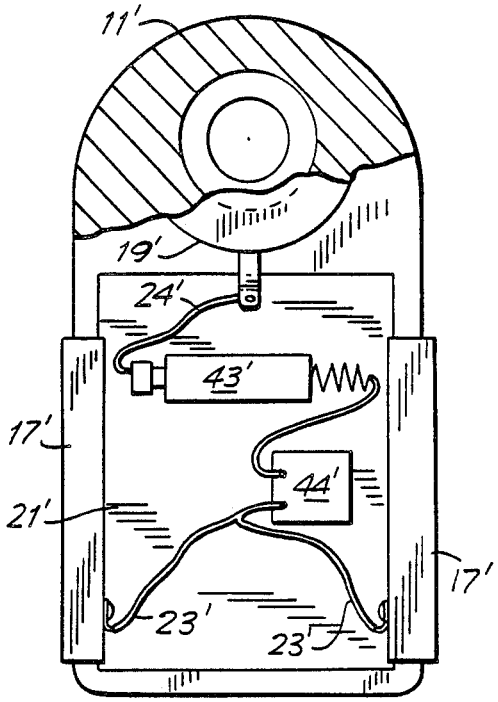
FIG. 10 is a rear view, partly in cross-section, of the pendulum of FIG. 9.
Figure 11:
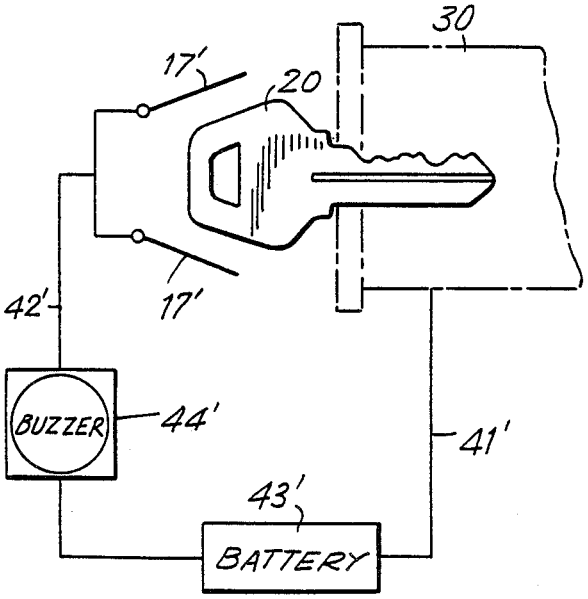
FIG. 11 is a circuit diagram for the embodiment of the warning device shown in FIGS. 5 through 10.

With particular reference to FIGS. 6 and 10, the pendulum 11' is constructed as a molded or fabricated module housing, as for example within its cavity 21', a battery 43' and a piezoelectric alarm or buzzer 44'. This module is formed of a rigid electrically nonconductive material and is insulated from a supporting fulcrum shaft 18' which projects outwardly from the cover plate 12'. A metal bushing 19' is tightly journaled into the module and has sufficient interior clearance to permit free rotation of the bushing relative to shaft 18' while maintaining electrical contact therebetween. The shaft 18' is hollow throughout its length to accommodate a metal bolt 16' which firmly fastens the base of the shaft to the faceplate 12'.

Referring now to FIG. 5, the bulk or principle mass of the pendulum, as supported by shaft 18', is normally disposed substantially directly below the shaft and sufficiently covers or adjoins the keyhole 32 of the lock 30 so as to prevent entry of a key into the keyhole. Access to the keyhole is achieved through a hole or slot 22' in the faceplate 12' as shown in FIG. 8, but only after the pendulum module is first pushed or otherwise manually displaced aside—in a direction and along a plane substantially perpendicular to the elongation of a key inserted into the lock—by the user to move the pendulum to a position remote from keyhole 32. When the pendulum is subsequently released by the user, the module pivots or swivels downwardly under the force of gravity, towards its inactive position A' (FIG. 7). If the key has been left in the lock cylinder, a contact portion or surface 17' of the pivoting module will come to rest against the metal key thereby completing and closing the indicator circuit illustrated, by way of example, in FIG. 11.

In the form of the invention depicted in FIGS. 5 to 11, the indicator circuit comprises a piezoelectric buzzer 44' in series electrical connection between a battery 43' and the pendulum contact surfaces 17'. The opposite pole of battery 43' is connected to a metal strip 24' fastened to bushing 19' Shaft 18' provides an electrical communication path between bushing 19' and faceplate 12' —which is preferably formed of an electrically conductive material—and a wire or metal strip 42' connects faceplate 12' (or shaft 18' where faceplate 12' is nonconductive) to lock 30'. The circuit is completed to sound alarm 44' when one of the pendulum contact surfaces 17' is moved or carried or driven into abutment with a metallic portion of a key 20 (or other electrically conductive object) projecting outwardly from keyhole 32. Those skilled in the art will appreciate that wire 42' may be omitted where both faceplate 12' and at least the outer or exterior face of the door are constructed of an electrically conductive material.

While there have been shown and described and pointed out the fundamental novel features of the invention as applied to several currently preferred embodiments thereof, it will be understood that various omissions and substitutions and changes in the form and details of the devices illustrated and in their operation, may be made by those skilled in the art without departing from the spirit of the invention. It is the intention, therefore, to be limited only as indicated by the scope of the claims appended hereto.

What is claimed is:

1. A warning device for indicating to a user that a key has been left in a lock, comprising:

movable contact means manually displaceable between a first position which proximately overlies a keyhole of lock for substantially preventing insertion of a key into the keyhole and a second position relatively spaced from the keyhole for noninterferingly permitting insertion of a key into the keyhole, said contact means being normally biased toward said first position; and alarm means connected between the lock and said contact means and operable, for indicating to a user that a key has been left in the lock, by displacement of said contact means from said second toward said first position and into abutment with a key left in the lock whereby a series electrical circuit is completed through said alarm means, said contact means, the key and the lock.

2. The warning device of claim 1, wherein said contact means comprises a flap.

3. The warning device of claim 1, wherein said contact means comprises a pendulum.

4. The warning device of claim 1, wherein said alarm means includes an audible signaler for sounding an alarm to indicate that a key has been left in the lock.

5. The warning device of claim 2, wherein said alarm means includes a audible signal for sounding an alarm to indicate that a key has been left in the lock.

6. The warning device of claim 3, wherein said alarm means includes an audible signaler for sounding an alarm to indicate that a key has been left in the lock.

* * * * *